US009310123B2

(12) United States Patent
Guarino et al.

(10) Patent No.: US 9,310,123 B2
(45) Date of Patent: Apr. 12, 2016

(54) METHOD OF MAKING AN APPLIANCE DOOR

(75) Inventors: James Charles Leslie Guarino, Kalamazoo, MI (US); James W. Kendall, Mount Prospect, IL (US); Alan S. Lucas, Evansville, IN (US); Vikas Malhotra, Evansville, IN (US); Keith Allen Snyder, Newburgh, IN (US); John J. VonderHaar, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/479,915

(22) Filed: May 24, 2012

(65) Prior Publication Data

US 2012/0227323 A1 Sep. 13, 2012

Related U.S. Application Data

(62) Division of application No. 12/504,739, filed on Jul. 17, 2009.

(51) Int. Cl.

| | |
|---|---|
| ***A47B 96/04*** | (2006.01) |
| ***B23P 17/00*** | (2006.01) |
| ***F25D 23/02*** | (2006.01) |

(52) U.S. Cl.
CPC . *F25D 23/02* (2013.01); *Y10T 29/49* (2015.01)

(58) Field of Classification Search
USPC ..... 29/460, 458, 527.1, 527.2; 264/46.5, 264/261; 220/592.1, 902; 312/400, 401, 312/406, 405, 405.1
See application file for complete search history.

(56) References Cited

U.S. PATENT DOCUMENTS

| | | | | | |
|---|---|---|---|---|---|
| 2,091,079 | A | * | 8/1937 | Money | 220/592.02 |
| 2,551,369 | A | * | 5/1951 | Frohnapel | 312/405 |
| 2,552,641 | A | * | 5/1951 | Morrison | 220/592.25 |
| 2,648,584 | A | * | 8/1953 | Morton | 312/296 |
| 2,760,301 | A | * | 8/1956 | Derr et al. | 160/383 |
| 2,794,331 | A | * | 6/1957 | Kogel | 62/141 |
| 3,401,815 | A | * | 9/1968 | Kesling | 220/592.08 |
| 3,440,308 | A | * | 4/1969 | Carbary et al. | 264/45.3 |
| 3,520,581 | A | * | 7/1970 | Borghi | 312/406 |
| 3,882,637 | A | * | 5/1975 | Lindenschmidt | 49/501 |
| 4,740,042 | A | * | 4/1988 | Stich et al. | 312/321.5 |
| 4,771,532 | A | * | 9/1988 | Taylor et al. | 29/455.1 |
| 5,007,226 | A | * | 4/1991 | Nelson | 52/784.15 |
| 5,033,182 | A | * | 7/1991 | Winterheimer et al. | 29/460 |
| 5,209,082 | A | * | 5/1993 | Ha | 62/265 |

(Continued)

FOREIGN PATENT DOCUMENTS

| | | | | | |
|---|---|---|---|---|---|
| DE | 20319183 | U1 | * | 6/2005 | F25D 23/06 |
| JP | 10009761 | A | * | 1/1998 | F25D 23/08 |
| JP | 2004216738 | A | * | 8/2004 | B29C 45/26 |

*Primary Examiner* — Essama Omgba

(57) ABSTRACT

A method of making an appliance door includes inserting a door pan into a fixture having first and second forming molds, which are pressed together. An inner door liner is placed over the door pan and secured thereto to form a base door. A mold cavity is formed between the door pan and the inner door liner. An insulative material is injected into the mold cavity defined by the space between the door pan and the inner door liner. A removable decorative exterior skin is extended over the base door. A support frame and a plurality of utility lines are provided. An insulative material contacts the support frame. A base door is formed by an inner door liner secured to the insulative material and the support frame.

20 Claims, 14 Drawing Sheets

(56) References Cited

U.S. PATENT DOCUMENTS 5,359,795 A * 11/1994 Mawby et al. ..... 40/405
5,588,731 A * 12/1996 Schmidt et al. ..... 312/405
5,704,107 A * 1/1998 Schmidt et al. ..... 29/460
5,909,937 A * 6/1999 Jenkins et al. ..... 312/405.1
5,941,619 A * 8/1999 Stieben et al. ..... 312/223.6
6,050,097 A * 4/2000 Nelson et al. ..... 62/137
6,138,932 A * 10/2000 Moore ..... 241/92
6,295,787 B1 * 10/2001 Lee ..... 52/784.15
6,491,287 B1 * 12/2002 Savenok ..... 256/59
6,841,108 B1 * 1/2005 Savenok ..... 264/162
7,908,882 B2 * 3/2011 Lee et al. ..... 62/344
7,942,017 B2 * 5/2011 Lee et al. ..... 62/344
8,042,353 B2 * 10/2011 Lee et al. ..... 62/344
8,117,865 B2 * 2/2012 Allard et al. ..... 62/440
8,220,204 B2 * 7/2012 Lee et al. ..... 49/463
8,230,647 B2 * 7/2012 Cho et al. ..... 49/501
8,336,974 B2 * 12/2012 Lee ..... F25D 23/028 312/204
8,336,975 B2 * 12/2012 Allard et al. ..... 312/405.1
8,375,539 B2 * 2/2013 Dunn et al. ..... 29/25.42
8,375,639 B2 * 2/2013 Lee et al. ..... 49/463
8,573,719 B2 * 11/2013 Lee et al. ..... 312/405
8,769,879 B2 * 7/2014 Lee et al. ..... 49/506
2003/0170594 A1 * 9/2003 Anderson et al. ..... 434/80
2003/0209832 A1 * 11/2003 Steil et al. ..... 264/328.7
2004/0041503 A1 * 3/2004 Lee ..... 312/406
2004/0183413 A1 * 9/2004 Koo ..... F25D 23/02 312/401
2004/0183414 A1 * 9/2004 Kwon ..... F25D 23/02 312/401
2005/0173323 A1 * 8/2005 Meuleners et al. ..... 210/184
2006/0219693 A1 * 10/2006 Earls et al. ..... 219/399
2008/0042537 A1 * 2/2008 Kim ..... F25D 23/02 312/405
2008/0231159 A1 * 9/2008 Lee et al. ..... 312/405
2009/0084128 A1 * 4/2009 Goerz et al. ..... 62/449
2009/0229298 A1 * 9/2009 Allard et al. ..... 62/449
2009/0282856 A1 * 11/2009 Buchstab ..... A47B 96/20 62/389
2010/0031580 A1 * 2/2010 Lee ..... F25D 23/028 49/504
2013/0086846 A1 * 4/2013 Lee ..... F25D 23/028 49/506
2013/0323461 A1 * 12/2013 Shim et al. ..... 428/121
2013/0334951 A1 * 12/2013 Allard ..... F25D 23/04 312/405

* cited by examiner

METHOD OF MAKING AN APPLIANCE DOOR

CROSS REFERENCE TO RELATED APPLICATION

This application is a divisional of U.S. patent application Ser. No. 12/504,739, entitled METHOD OF MAKING AN APPLIANCE DOOR, filed on Jul. 17, 2009, the disclosure of which is hereby incorporated by reference in its entirety.

BACKGROUND OF THE PRESENT INVENTION

The present invention generally relates to a method of making an appliance door, and more specifically, to a method of making an appliance door that can be used on a variety of refrigerator constructions. New refrigerator designs are incorporating flexible design concepts allowing the consumer to select different features. Some of the features include, for example, module components. These and other modules operate using utilities in the form of electrical power, data signals, and fluids in either liquid or gaseous form, or the like.

SUMMARY OF THE INVENTION

In one aspect of the present invention, a method of making an appliance door includes inserting a door pan into a fixture having first and second forming molds. An inner door liner is placed over the door pan. The first and second forming molds are pressed together. A mold cavity is formed between the door pan and the inner door liner. An insulative material is injected into the mold cavity defined by the space between the door pan and the inner door liner. The inner door liner is secured to the door pan to form a base door. A removable decorative exterior skin is extended over the base door.

In another aspect of the present invention, a method of making an appliance door includes inserting a film into a fixture having first and second forming molds. An inner door liner is placed over the film. The first and second forming molds are pressed together. A mold cavity is formed between the film and the inner door liner. An insulative material is injected into the mold cavity defined by the space between the film and the inner door liner. The inner door liner is secured with the frame to form a base door. A removable decorative exterior skin is extended over the base door.

In yet another aspect of the present invention, a method of making an appliance door includes inserting a support frame into a fixture having first and second forming molds. Utility lines are inserted into the fixture. The first and second forming molds are pressed together. An insulative material is injected between the first and second forming molds in contact with the support frame. The injected insulative material is set to form a base door. An inner door liner is secured over the base door. A removable decorative exterior skin is extended over the base door.

These and other features, advantages and objects of the present invention will be further understood and appreciated by those skilled in the art upon studying the following specification, claims, and appended drawings.

DETAILED DESCRIPTION OF EMBODIMENTS

Figure 2:
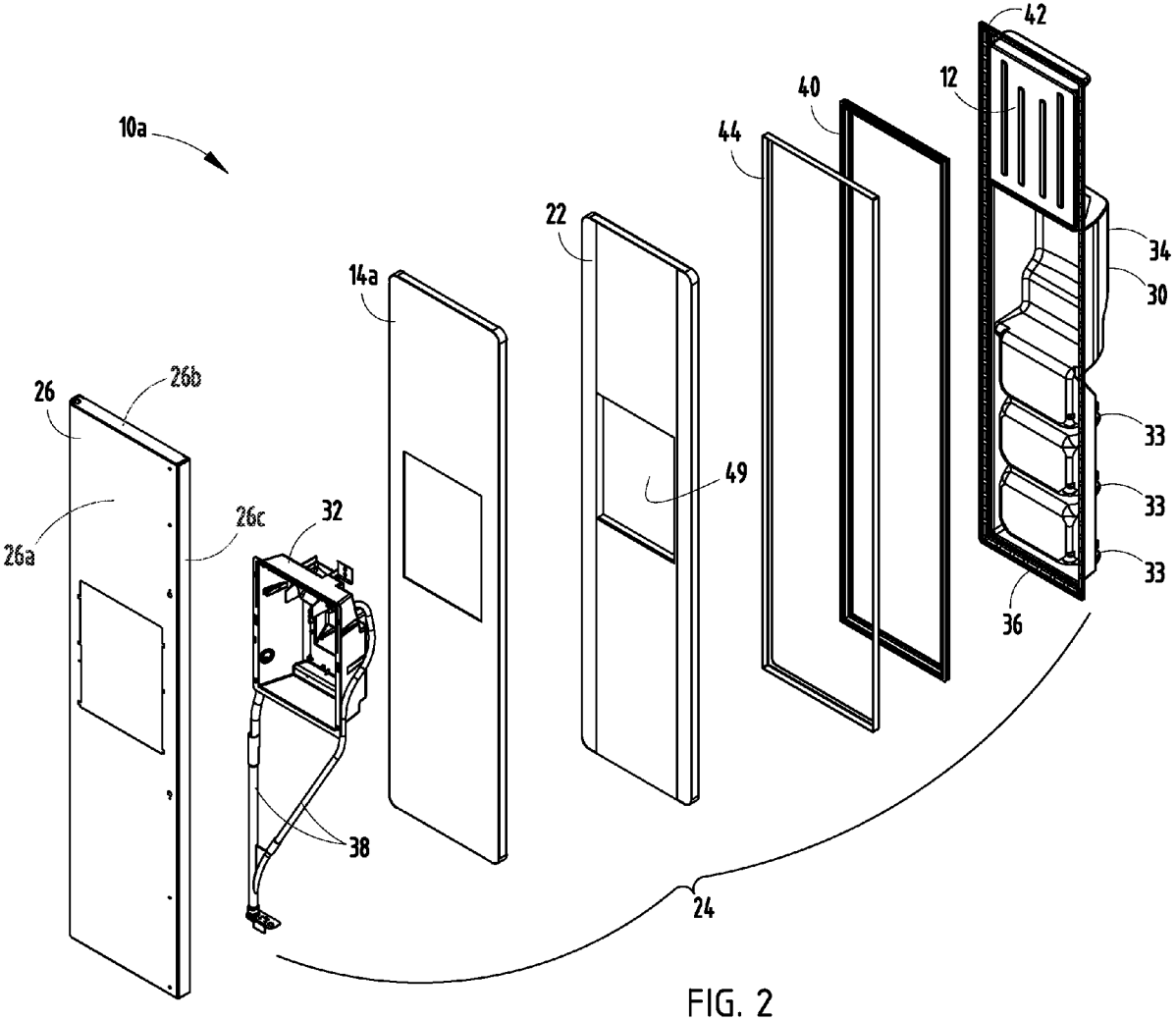
FIG. 2 is a top front exploded perspective view of one embodiment of a door assembly.

For purposes of description herein the terms "upper," "lower," "right," "left," "rear," "front," "vertical," "horizontal," and derivatives thereof shall relate to the invention as oriented in FIG. 2. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1A:
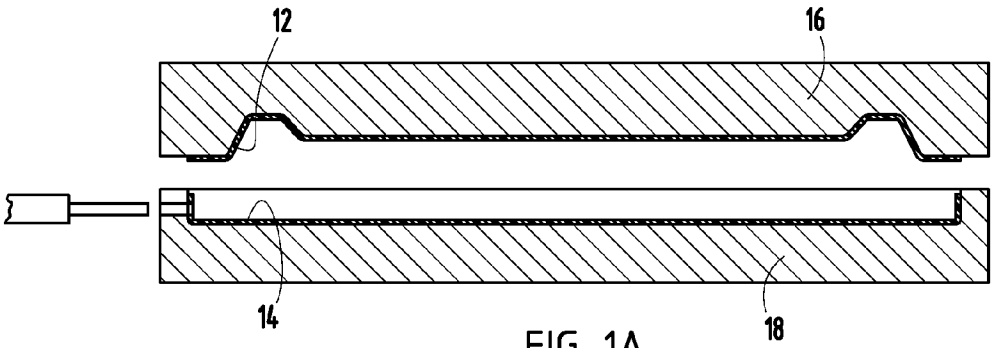
FIG. 1A is a side cross-sectional elevational view of a mold cavity prior to constructing a base door.
Figure 1B:
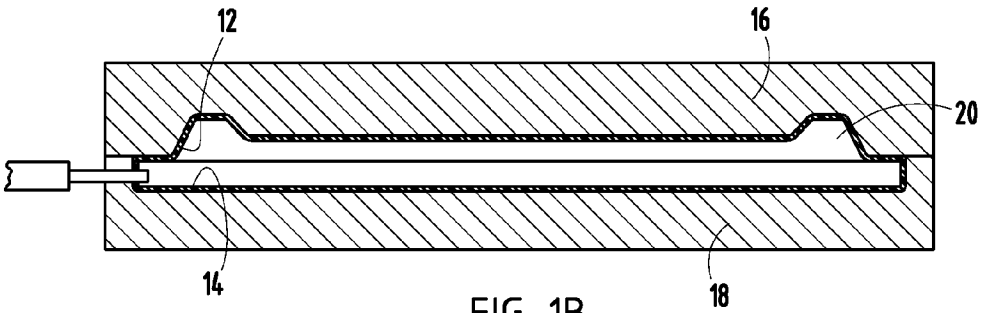
FIG. 1B is a side cross-sectional elevational view of a mold cavity during insertion of insulative material.
Figure 1C:
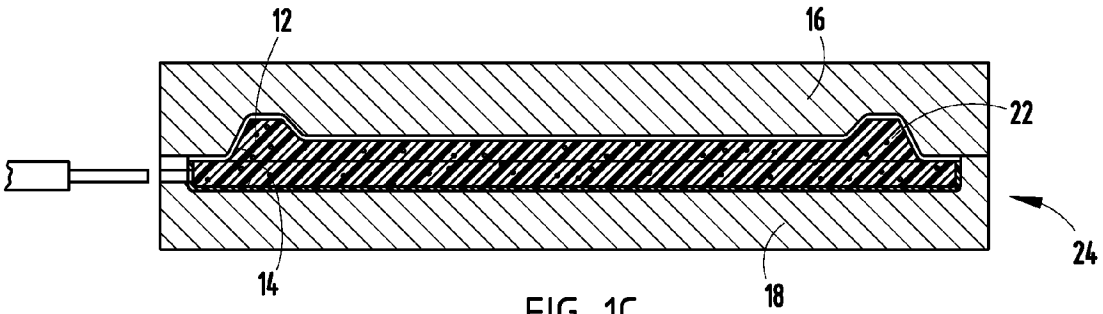
FIG. 1C is a side cross-sectional elevational view of a mold cavity after insulative material has been placed in the mold cavity.
Figures 12, 13, 14, 15, 16, 17:
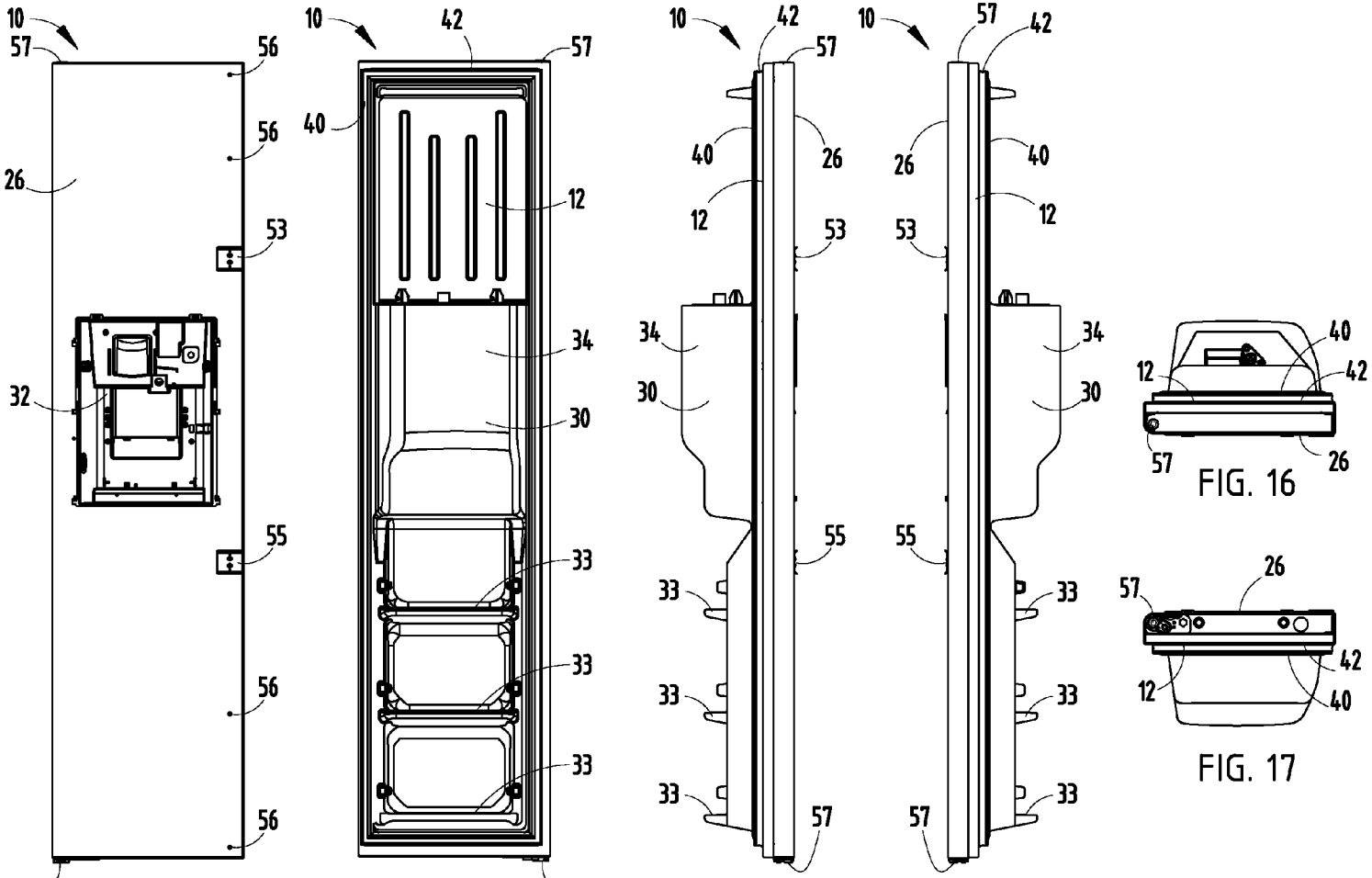
FIG. 12 is a front elevational view of a completed door assembly.
FIG. 13 is a rear elevational view of the door assembly of FIG. 12.
FIG. 14 is a left side elevational view of the door assembly of FIG. 12.
FIG. 15 is a right side elevational view of the door assembly of FIG. 12.
FIG. 16 is a top elevational view of the door assembly of FIG. 12.
FIG. 17 is a bottom elevational view of the door assembly of FIG. 12.

FIGS. 1A-1C generally illustrate a method of making an appliance door 10 (FIG. 12). An inner door liner 12 is placed over the door pan 14*a*. First and second forming molds 16, 18 of a fixture are pressed together. A cavity 20 is formed between the door pan 14*a* and the inner door liner 12. An insulative material 22 is injected into the cavity 20 defined by the space between the door pan 14*a* and the inner door liner 12. The inner door liner 12 is secured to the door pan 14*a* to form a base door 24 and a perimeter gasket 40 is affixed thereto. A decorative exterior skin 26 (FIG. 2) is extended over the base door 24.

The reference numeral 10 generally designates an appliance door and is intended to cover each variation of constructing a door as disclosed herein and equivalents thereof, including doors 10*a*, 10*b*, 10*c*, 10*d*, and 10*e*.

Figure 3:
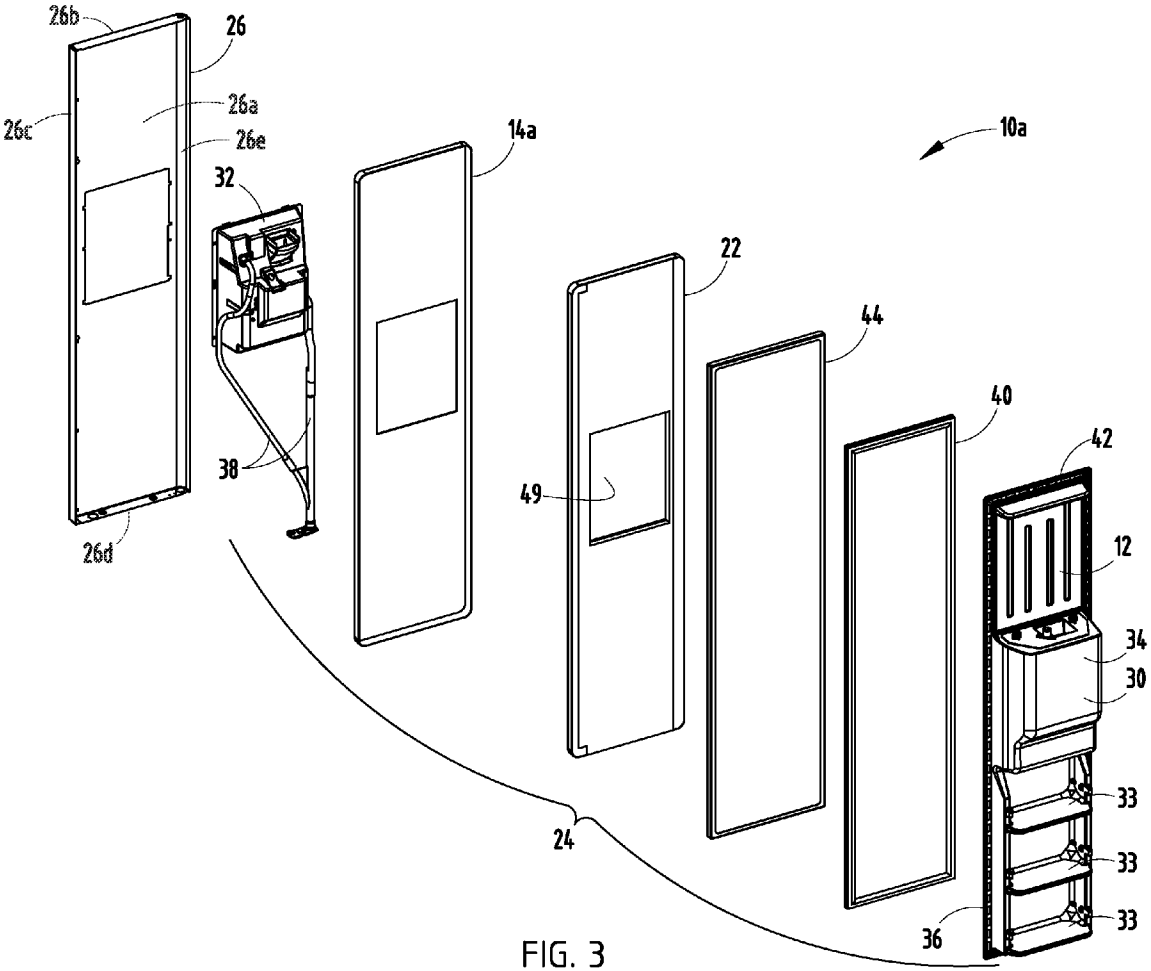
FIG. 3 is a top rear exploded perspective view of the door assembly of FIG. 2.

Referring now to FIGS. 2-3, the inner door liner 12 may include any of a number of configurations. The illustrated embodiment of FIGS. 2 and 3 includes a projection 30 in the inner door liner 12 for receiving a storage unit or module such as an ice machine 32. The projection 30 projects into an interior side 34 of the inner door liner 12, but opens to an exterior side 36 (FIG. 2). Multiple shelves 33 are disposed below the projection 30 and are adapted to support food goods or feature modules disposed thereon. It is contemplated that the inner door liner 12 is formed from any of a number of materials, including high impact polystyrene, ABS, and polyethylene. The ice machine 32 extends into the projection 30 in the inner door liner 12 and includes conduits 38 that are disposed between the insulative material 22 and the door pan 14*a*. Alternatively, the conduits 38 may extend into channels formed in the insulative material 22. The conduits 38 are designed to receive utility lines including electrical lines and water lines. A gasket 40 extends around a periphery of the inner door liner 12 and is held against a perimeter flange integral to the door pan 14*a*. The door pan 14*a* is adhesively bonded by the insulative material 22 to inner door liner 12 to form the base door 24. The decorative outer skin 26 is then secured over the base door 24 adjacent to the door pan 14*a* to form the appliance door 10*a*. The door pan 14*a* provides structural support to the appliance door 10*a*.

Referring again to FIGS. 2 and 3, an aperture 49 is made in the insulative material 22 during the foaming process or made after the insulative material 22 has set and hardened. The aperture 49 is designed to accommodate a wide variety of modules and devices and may be formed during door construction in a multitude of ways. Specifically, the aperture 49 may be cut out after the base door 24 is formed, or after the complete door 10 is constructed. Alternatively, the aperture 49 may be made using a block that creates a void in the door during the injection of foam material 22 into the cavity 20. The block is later removed to create the aperture 49. A decorative exterior skin 26 may then be assembled over the pan 14*a* to provide aesthetic variation for door 10*a* in terms of shape, color, finish, or material type. The decorative exterior skin 26, as illustrated, includes a face wall 26*a*, as well as a plurality of perpheral sidewalk 26*b*, 26*c*, 26*d*, 26*e*.

Figures 4, 4A:
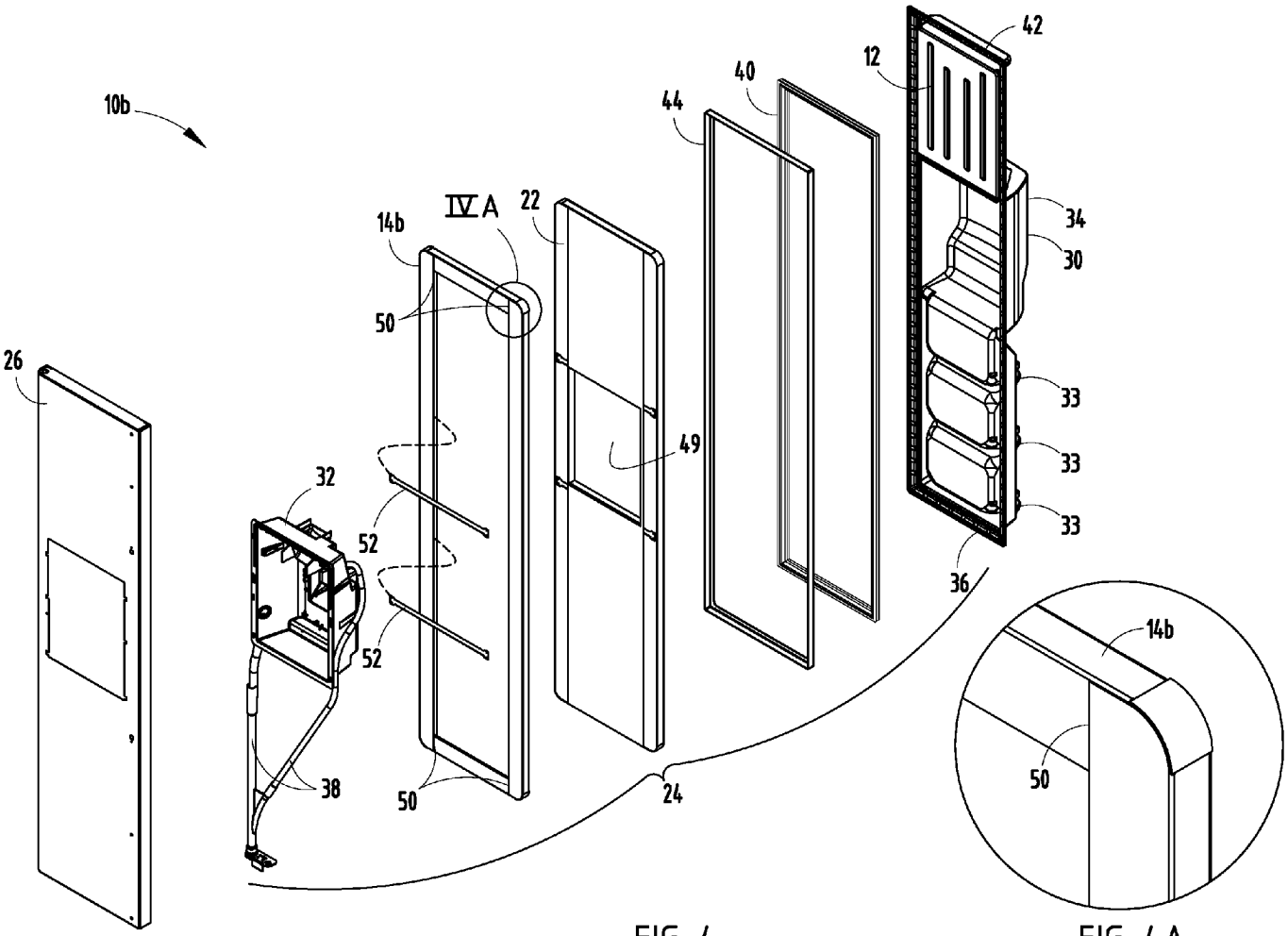
FIG. 4 is a top front exploded perspective view of another embodiment of a door assembly.
FIG. 4A is an enlarged top perspective view of area IVA of FIG. 4.
Figure 5:
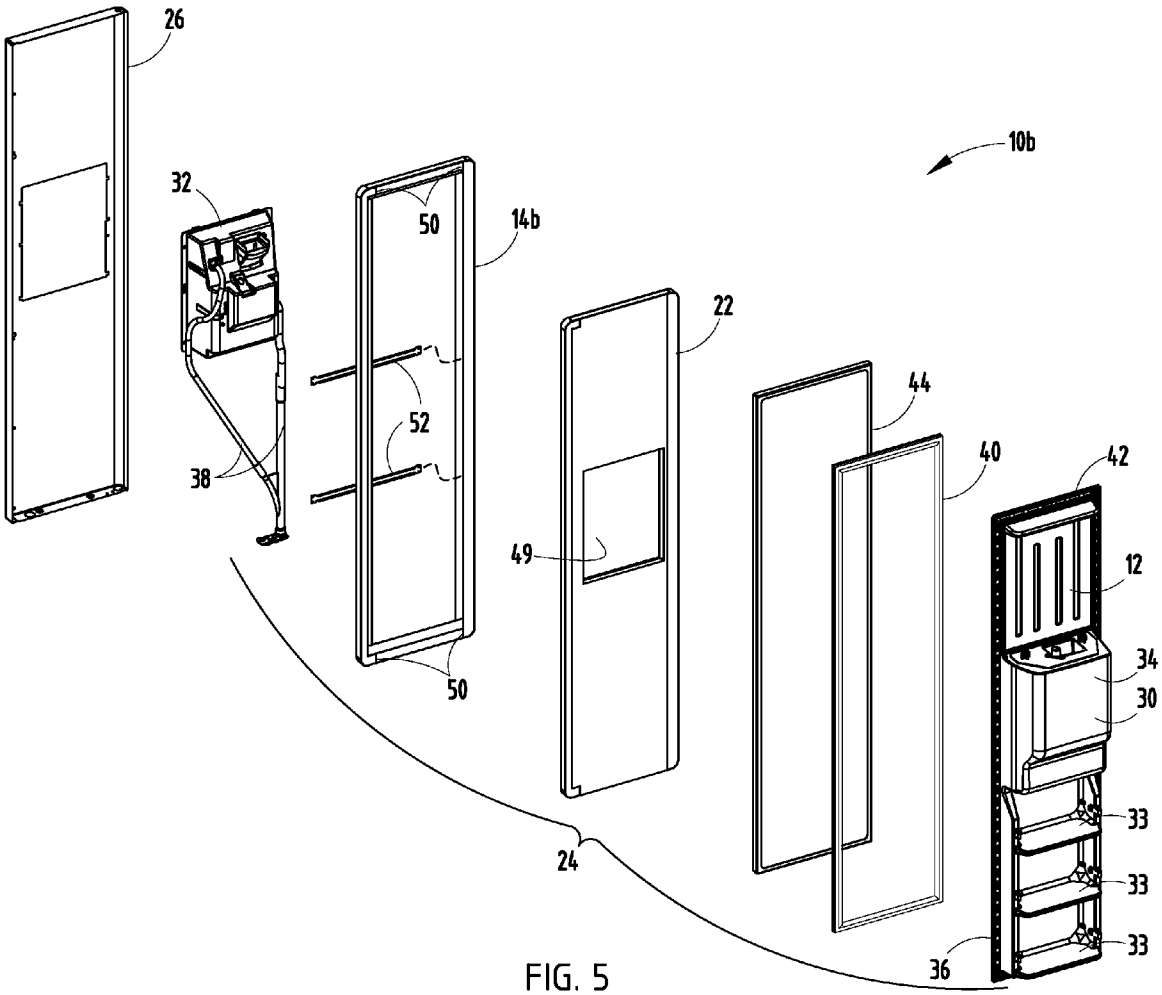
FIG. 5 is a top rear exploded perspective view of the door assembly of FIG. 4.

Referring now to the embodiment illustrated in FIGS. 4 and 5, another manner of assembling an appliance door 10*b* includes inserting the inner door liner 12 and gasket 40 in the first and second forming molds 16, 18 (FIGS. 1A-1C) which are subsequently pressed together. The insulative material 22, which is polyurethane or a similar material, is then inserted into the cavity 20 formed by the first and second forming molds 16, 18. A release agent or film 51*b* is placed against the mold surface of the second forming mold. The film 51*b* may be of polyethylene or similar material. The film 51*b* can also be used as a moisture barrier that inhibits moisture from entering the insulative material 22. A frame 14*b* having a tubular construction (FIGS. 4 and 5) is then placed in abutting contact with the insulative material 22, and the inner door liner 12 and gasket 40 are secured with the inner door liner 12 by the door flange 44. A component, such as the ice machine 32 is placed in the appliance door 10*b* in operable connection with the inner door liner 12 and is accessible from the outside of the appliance door 10*b*. The tubular outer frame 14*b* adds rigidity to the appliance door 10*b* and is fastened or welded at each corner 50, as shown in FIG. 4A. Cross members 52 are positioned at predetermined points in the frame 14*b*, to add additional strength, as needed. The cross members 52 may be welded or mechanically fastened to the frame 14*b* at positions that do not interfere with components that may be installed in the door 10*b*. If the film 51*b* or release agent is present on both sides of the insulative material 22, the inner door liner 12 may be secured to the frame 14*b* by mechanical fasteners.

Figures 6, 6A:
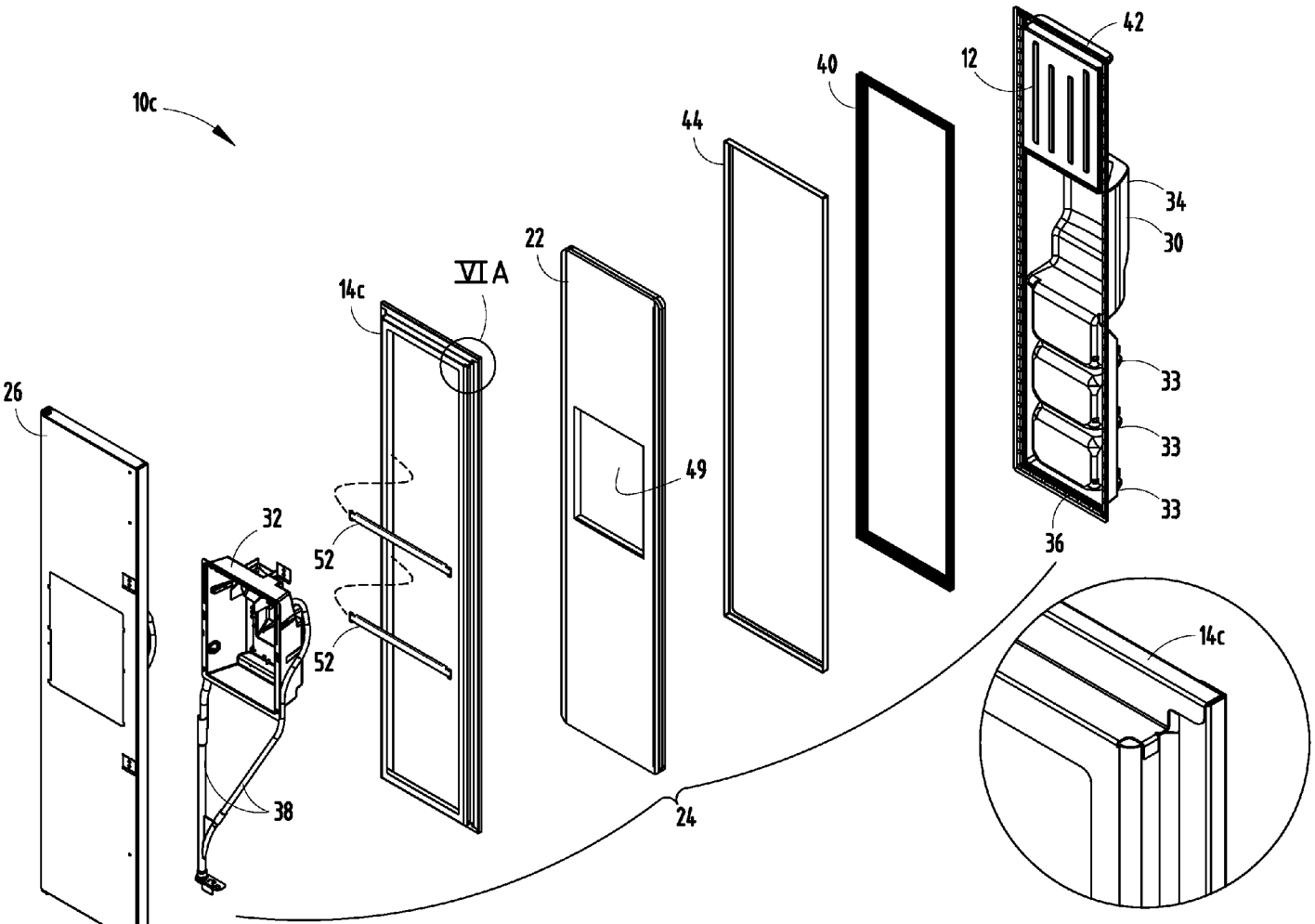
FIG. 6 is a top front exploded perspective view of another embodiment of a door assembly.
FIG. 6A is an enlarged top perspective view of area VIA of FIG. 6.
Figure 7:
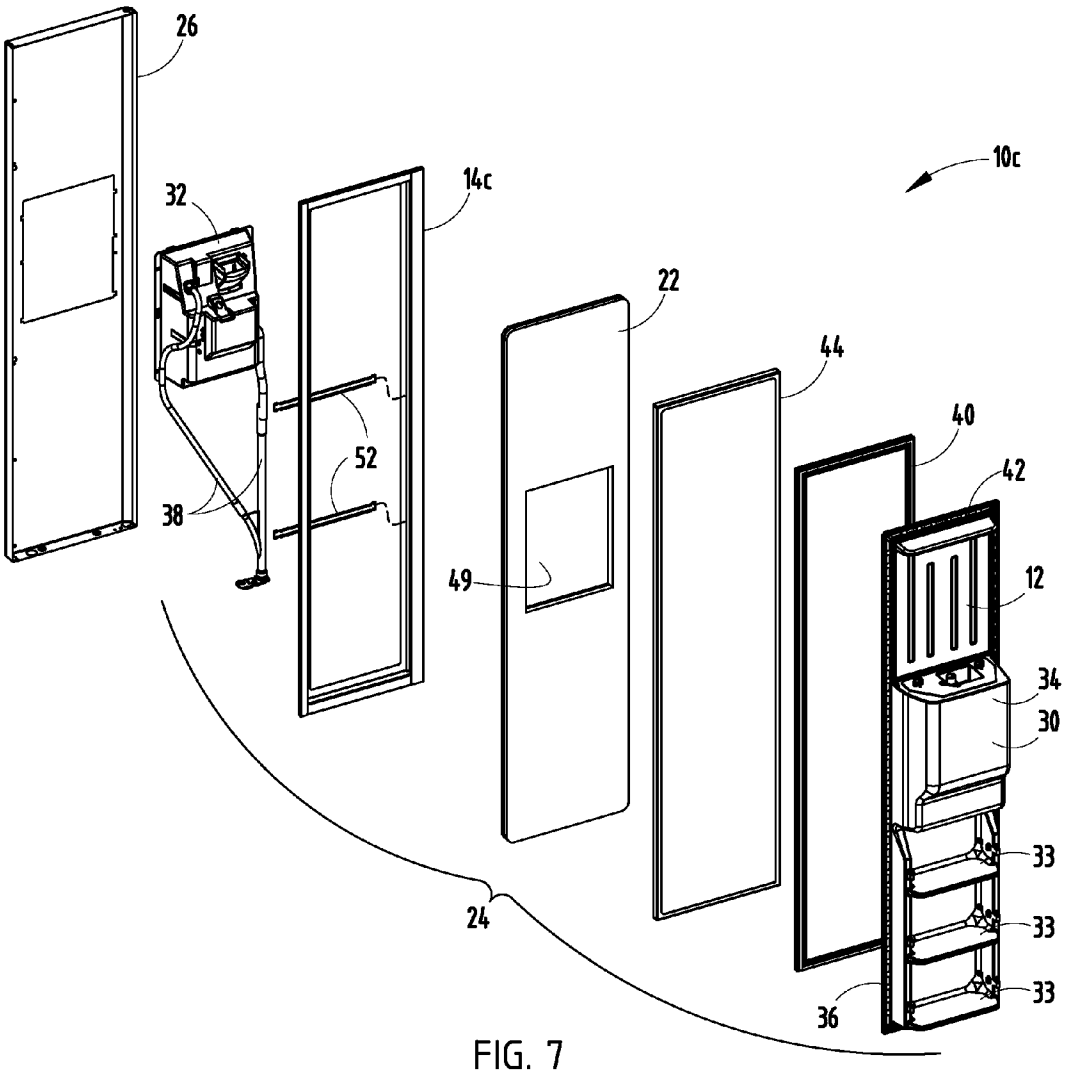
FIG. 7 is a top rear exploded perspective view of the door assembly of FIG. 6.

Alternatively, as shown in the embodiment illustrated in FIGS. 6 and 7, an appliance door 10*c* may use a stair-step frame 14*c* having a three-dimensional stair-step design instead of the tubular construction of frame 14*b*. The stair-step frame 14*c* is formed from a single metal blank and stamped or folded on a break press, for example, then cut and bent into typically a rectangular shape and the adjoining ends fastened mechanically or by tack weld to provide a unitary frame 14*c* (FIG. 6A). It is contemplated that the stair-step design could have a variety of constructions with varying dimensions, depending on the required rigidity, weight, and versatility desired.

Figure 8:
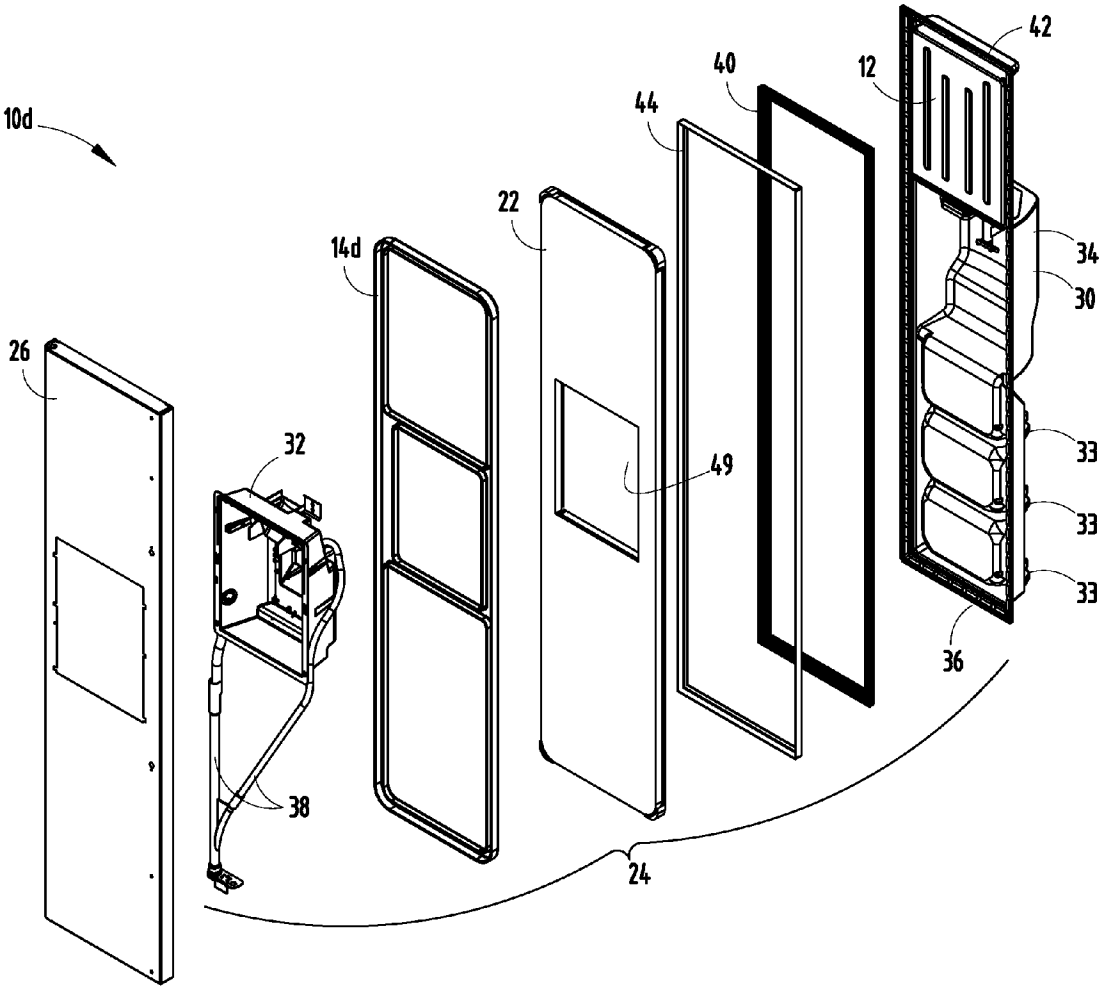
FIG. 8 is a top front exploded perspective view of another embodiment of a door assembly.
Figure 9:
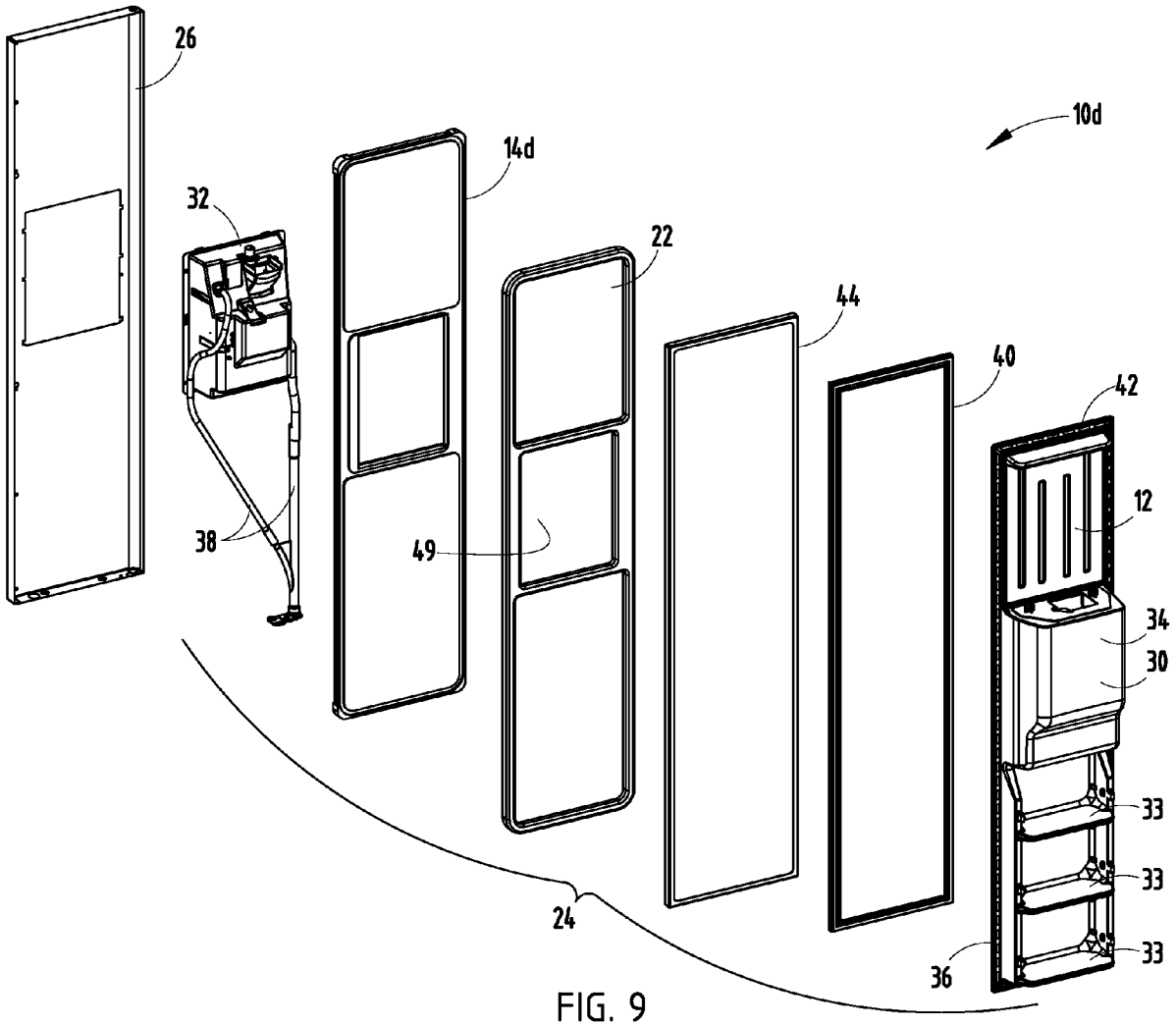
FIG. 9 is a top rear exploded perspective view of the door assembly of FIG. 8.

Referring now to the embodiment illustrated in FIGS. 8 and 9, yet another manner of assembling the appliance door 10*d* includes inserting a frame 14*d* into the mold cavity 20. The frame 14*d* may include molded plastic, metal, or other material, and may be in various forms, including H-beam, I-beam, U-channel, or other configurations. In addition, the frame 14*d* may include utility lines 38 and mounting hardware adapted to connect with components that may exist in the appliance door 10*d*. The frame 14*d* is either encased in or bonded to the insulative material 22 in the mold cavity 20. After the insulative material 22 cures around the frame 14*d* and is connected or bonded to the inner door liner 12 and gasket 40, a component, such as the ice machine 32 shown is installed in the frame 14*d* and connected with utility lines 38 to form the base door 24. A decorative exterior skin 26 may then be assembled over the base door 24 to provide aesthetic variation in shape, color, finish, or type of material for door 10*d*.

Figure 10:
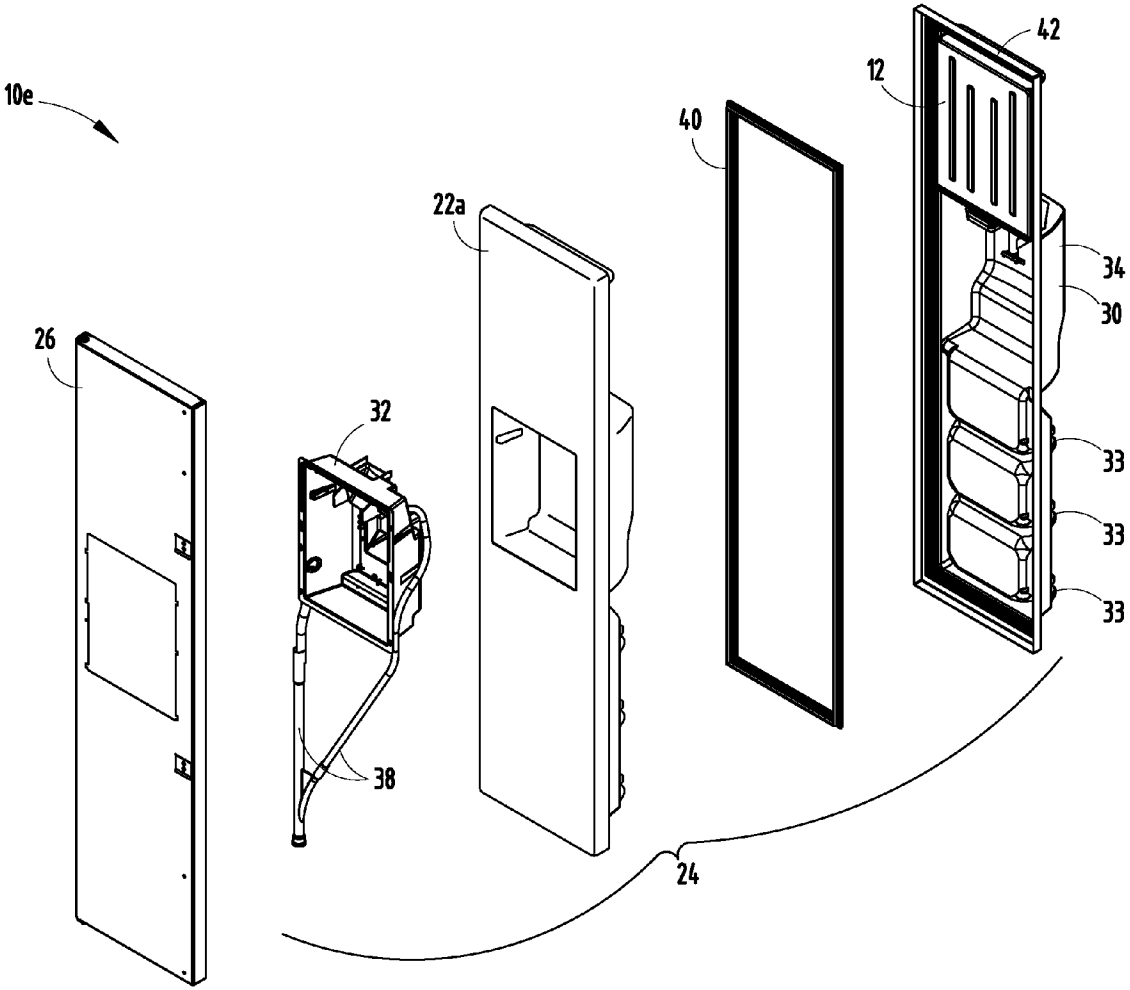
FIG. 10 is a top front exploded perspective view of another embodiment of a door assembly.
Figure 11:
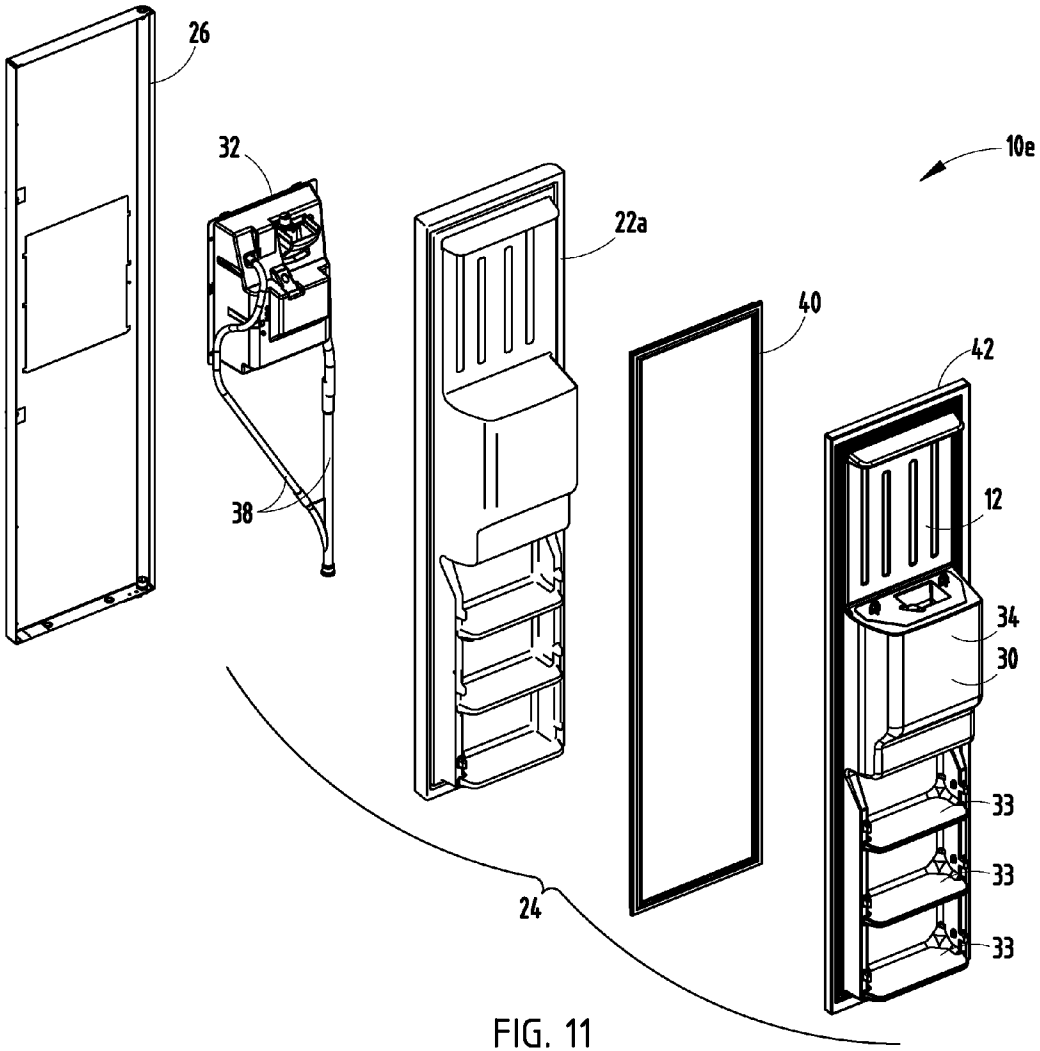
FIG. 11 is a top rear exploded perspective view of the door assembly of FIG. 10.

Referring now to the embodiment illustrated in FIGS. 10 and 11, yet another manner of assembling an appliance door 10*e* includes inserting a release agent or film 51*e* against the mold surface of the second forming mold 18 (FIGS. 1A-1C). The first and second forming molds 16, 18 are then closed and insulative material 22 is inserted into the cavity 20. The insulative material 22 conforms to the shape of the inner door liner 12. The inner door liner 12 and insulative material 22 are then withdrawn from the mold as a single frameless unit. The film 51*e* may be polyethylene or similar material. The film 51*e* can also be used as a moisture barrier. A component, such as the ice machine 32 shown, is inserted into the aperture 49 in the insulative material 22. The utility lines 38 may be encased in the insulative material 22, or may extend through channels 39 formed to receive the utility lines 38. The exterior skin 26, gasket 40, and door flange 44 are then press-fitted or otherwise fastened together about the periphery of the appliance door 10*e*. The insulative material 22, when assembled with the inner liner 12, decorative exterior skin 26 and flange 44, provides the structural rigidity for the appliance door 10*e*.

It is contemplated that pockets could be made in the insulative material 22 to accommodate removable insulation panels, such as those disclosed in U.S. patent application Ser. No.

12/466,398, entitled "VACUUM INSULATION PANELS APPLIED TO OR AS A FEATURE MODULE," filed on May 15, 2009, the entire disclosure of which is hereby incorporated by reference, or storage compartments, such as those disclosed in U.S. patent application Ser. No. 12/402,608, entitled "PLENUM ON FRONT OF REFRIGERATOR/FREEZER DOOR," filed on Mar. 12, 2009, the entire disclosure of which is hereby incorporated herein by reference, as well as removable modules or components, etc., such as those disclosed in U.S. patent application Ser. No. 12/402,559, entitled "VACUUM FOOD PRESERVATION SYSTEM," filed on Mar. 12, 2009; U.S. patent application Ser. No. 12/402,747, entitled "CHILLING AND THAWING MODULAR APPLIANCE SYSTEM," filed on Mar. 12, 2009; and U.S. patent application Ser. No. 12/402,731, entitled "MODULAR DOOR MOUNTED CLIMATE CONTROLLED MEDICINE COMPARTMENT," filed on Mar. 12, 2009, the entire disclosures of which are hereby incorporated herein by reference. The decorative exterior skin 26 may then be assembled over the base door 24 to provide aesthetic variation in shape, color, finish, or type of material for door 10*e*.

FIGS. 12-17 illustrate one embodiment of the assembled appliance door 10. The appliance door 10 includes first and second brackets 53, 55 (FIG. 12) that are designed to secure a handle (not shown) to the door 10. Tabs 56 are also disposed along the door edge for connection of a trim piece (not shown). The interior of the door 10 has the shelves 33 disposed at the bottom of the door 10, however, it is contemplated the shelves 33 and any components (such as the ice machine 32) could be arranged in various manners or styles, as desired by the end user. Pin receivers 57 are designed to receive pivot pins about which the door 10 can rotate between open and closed positions after installation.

The appliance door 10 discussed above is designed for use with a variety of decorative skins 26. Accordingly, it is contemplated that a single base door 24 may be used across a breadth of appliances or models with the decorative outer skin 26 being the only changed item. The decorative outer skin 26 may have a variety of constructions and is adapted to receive a variety of components. In addition, the base door 24 may be connected with, for example, the decorative outer skin 26 by press-fitting, and later have the decorative outer skin 26 removed and have a different decorative outer skin 26 secured over the base door 24 by end caps 64 that extend over the top and bottom edges 66, 68 of the inner door liner 12 to hold the exterior skin 26 in place, as discussed in further detail below.

Figure 19:
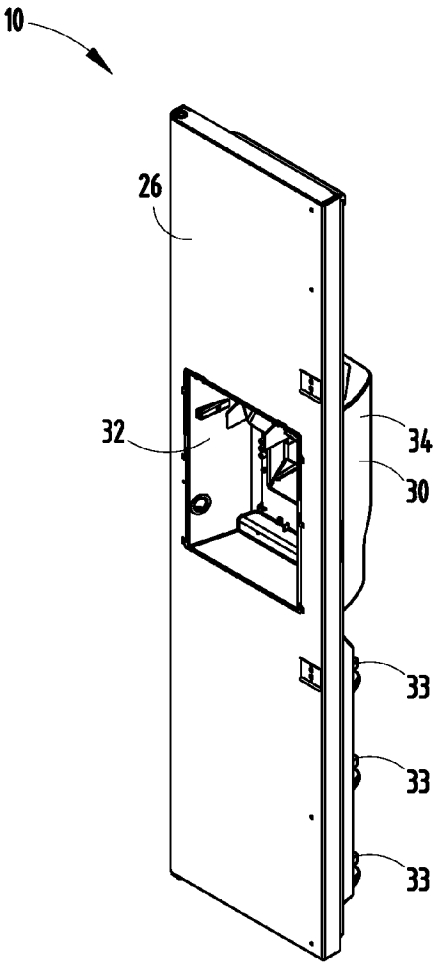
FIG. 19 is a top perspective view of a press fit door assembly.
Figure 18:
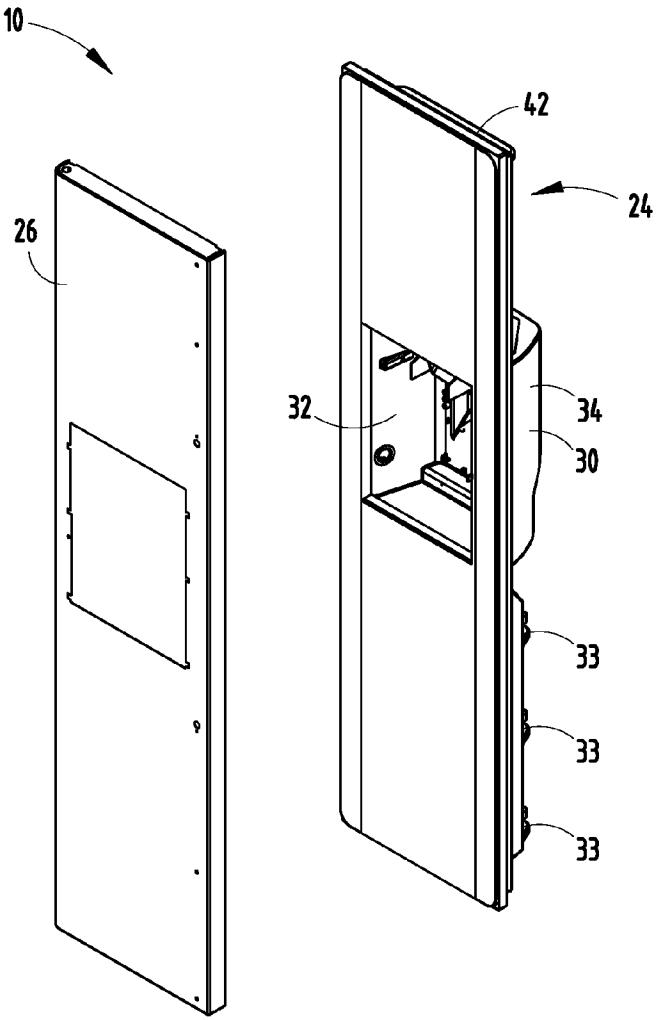
FIG. 18 is a top perspective partially exploded view of a press fit door assembly.
Figure 21:
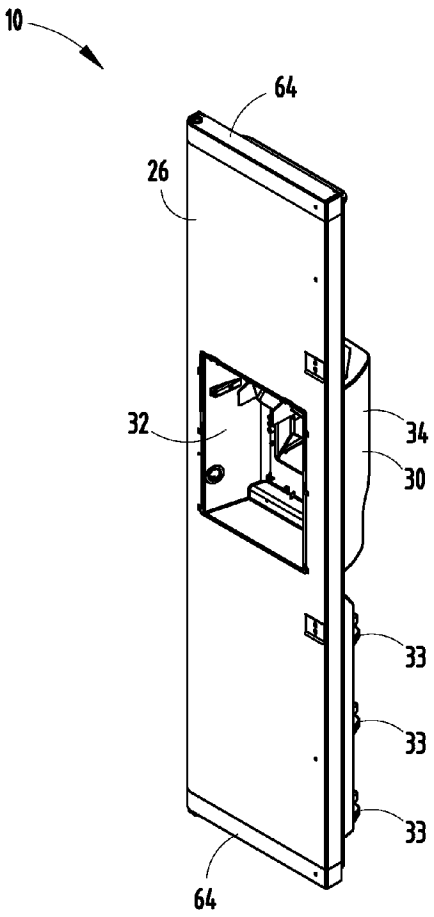
FIG. 21 is a top perspective view of a door assembly with top and bottom end caps.
Figure 20:
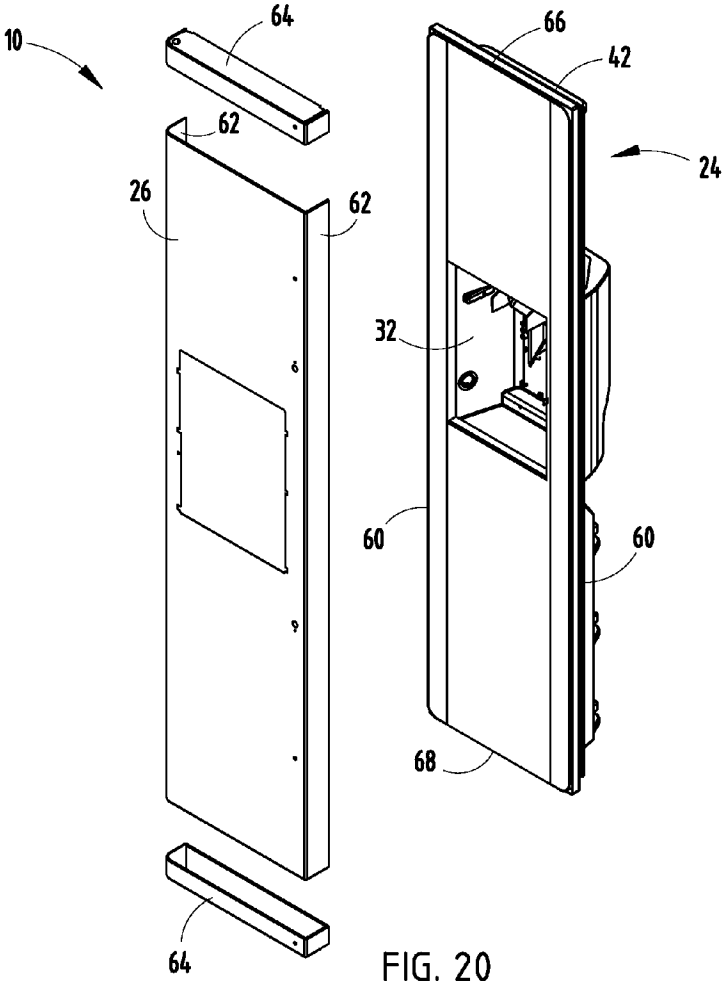
FIG. 20 is a top perspective partially exploded view of a door assembly with top and bottom end caps.

Referring now to FIGS. 18-21, in each of the aforementioned embodiments, it is conceivable that the exterior skin 26 may be press-fitted to the inner door liner 12, such as shown in FIGS. 18 and 19, or may be wrapped around side edges 60 of the inner door liner 12 as shown in FIGS. 20 and 21. End walls 62 of the exterior skin 26 cover the side edges 60 and abut the inner door liner 12. In the event that the exterior skin 26 is wrapped around side edges 60 of the inner door liner 12, then end caps 64 are situated over top and bottom edges 66, 68 of the inner door liner 12 to hold the exterior skin 26 in place. The decorative outer skin 26 can also be permanently bonded adhesively or by other mechanical means such as clips or screws.

The above description is considered that of the illustrated embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A method of making an appliance door comprising:

forming a support frame having a generally rectangular perimeter, the support frame having an aperture in a central area;

inserting the support frame into a fixture having first and second forming molds;

inserting utility lines into the fixture;

pressing the first and second forming molds together to from a cavity;

injecting an insulative material into the cavity, wherein the support frame is encased in the insulative material;

inserting a block into the fixture before the first and second forming molds are pressed together to form an aperture in a central area of the insulative material and maintain the aperture in the central area of the support frame, wherein the apertures in the central areas of the support frame and of the insulative material are configured to receive an ice machine;

setting the injected insulative material, wherein the insulative material is cured around the support frame, thereby connecting or bonding the support frame to the insulative material;

providing an inner door liner having a generally rectangular perimeter having a shape and size that closely corresponds to the rectangular perimeter of the support frame;

securing the inner door liner to the set injected insulative material and support frame to form a base door; and securing a rigid decorative exterior skin over the base door, the decorative exterior skin including a face wall and a plurality of peripheral sidewalls that extend orthogonal to each side of the face wall.

2. The method of claim 1, further comprising:

placing a gasket assembly adjacent the inner door liner and the exterior skin.

3. The method of claim 2, further comprising:

extending a door flange over the gasket assembly that secures the gasket assembly in position around a periphery of the appliance door.

4. The method of claim 1, wherein:

the step of inserting a support frame further comprises inserting a support frame having tubular support members.

5. The method of claim 1, wherein:

the step of inserting a support frame further comprises inserting a support frame having a single support member extending longitudinally through a central portion of the door.

6. The method of claim 1, wherein:

the step of inserting a support frame further comprises inserting a support frame made from rigid plastic.

7. The method of claim 1, wherein:

the step of inserting a support frame further comprises inserting a support frame formed from a single piece of stamped metal.

8. The method of claim 1, wherein:

the step of removably securing a decorative exterior skin further comprises fastening the rigid decorative exterior skin onto the base door with mechanical fasteners.

9. The method of claim 1, further comprising:

cutting an aperture from the base door before the decorative exterior skin is removably secured over the base door.

10. The method of claim 1, wherein:

the support frame comprises a metal frame that is formed by bending and cutting metal prior to insertion of the metal frame into the mold, and wherein the metal frame defines an interior space within the rectangular perimeter; and:

the step of injecting insulative material into the cavity includes distributing insulative material in the interior space while the metal frame is in the mold to thereby form, upon solidification of the insulative material, a unitary base panel structure having a central portion comprising insulative material and a generally rectangular perimeter defined by the metal frame.

11. The method of claim 10, wherein:

the metal frame includes a hinge structure.

12. The method of claim 10, wherein:

the insulative material includes opposite side faces defining a first thickness there between; and the rectangular perimeter of the support frame defines a second thickness that is approximately equal to the first thickness.

13. An appliance door comprising:

a support frame having a generally rectangular perimeter, the support frame having an aperture in a central area;

a plurality of utility lines;

an insulative material that is injected into a cavity formed between first and second forming molds; the insulative material encasing the support frame, wherein the insulative material is cured around the support frame;

a block inserted into the cavity before the first and second forming molds are pressed together forms an aperture in a central area of the insulative material and maintains the aperture in the central area of the support frame, wherein the apertures in the central areas of the support frame and of the insulative material are configured to receive an ice machine;

an inner door liner that is secured to the insulative material and support frame, forming a base door, the inner door liner having a generally rectangular perimeter having a shape and size that closely corresponds to the rectangular perimeter of the support frame; and a rigid decorative exterior skin that is secured over a front and sides of the base door to provide aesthetic variation in shape, color, finish, or type of material for the appliance door.

14. The appliance door of claim 13, further comprising:

a gasket assembly disposed adjacent the inner door liner and the decorative exterior skin and a door flange that extends over the gasket assembly, securing the gasket assembly in position around a periphery of the appliance door.

15. The appliance door of claim 13, further comprising:

outer end caps for covering a top end and a bottom end of the base door.

16. The appliance door of claim 13, wherein:

the support frame includes tubular support members.

17. The appliance door of claim 13, wherein:

the support frame includes a single support member that extends longitudinally through a central portion of the door.

18. The appliance door of claim 13, wherein:

the support frame is formed from a single piece of stamped metal.

19. The appliance door of claim 13, wherein:

an aperture is formed in the insulative material for receiving a component.

20. The appliance door of claim 13, wherein:

an aperture is cut in the base door before the decorative exterior skin is removably secured over the base door.

* * * * *